US010626654B2

(12) United States Patent
Logan et al.

(10) Patent No.: US 10,626,654 B2
(45) Date of Patent: Apr. 21, 2020

(54) SPRING SHOCK LID STAY

(71) Applicant: Suncast Technologies, LLC, Palm Beach Gardens, FL (US)

(72) Inventors: Samuel G. Logan, West Chicago, IL (US); Michael Thuma, La Grange, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 178 days.

(21) Appl. No.: 15/987,518

(22) Filed: May 23, 2018

(65) Prior Publication Data

US 2019/0360252 A1 Nov. 28, 2019

(51) Int. Cl.

| | |
|---|---|
| ***E05F 11/00*** | (2006.01) |
| ***E05F 3/22*** | (2006.01) |
| ***A45C 13/34*** | (2006.01) |

(52) U.S. Cl.

CPC ..... *E05F 3/224* (2013.01); *A45C 13/345* (2013.01); *E05Y 2201/422* (2013.01); *E05Y 2201/428* (2013.01); *E05Y 2201/474* (2013.01); *E05Y 2800/28* (2013.01); *E05Y 2800/372* (2013.01); *E05Y 2900/602* (2013.01)

(58) Field of Classification Search

CPC ..... E05F 3/224; E05F 3/10; E05F 3/22; E05F 1/14; E05F 15/163; E05F 15/16; E05Y 2900/602; E05Y 2201/422; E05Y 2201/474; E05Y 2800/372; E05Y 2201/428; E05Y 2800/28; E05Y 2800/24; E05Y 2900/20; E05D 15/46; E05D 3/12; A45C 13/345; A45C 13/34; Y10T 16/53885; Y10T 16/5383; Y10T 16/54034

USPC ..... 49/339, 246, 247, 251; 220/323, 830; 16/286, 308, 338; 190/30

See application file for complete search history.

(56) References Cited

U.S. PATENT DOCUMENTS

| | | | | |
|---|---|---|---|---|
| 1,590,041 A | | 6/1926 | Lamb | |
| 2,723,776 A | | 11/1955 | Jacobson | |
| 2,842,278 A | | 7/1958 | Murphy | |
| 2,903,149 A | * | 9/1959 | Alonzo | E05F 1/1058 217/60 E |
| 3,324,502 A | | 6/1967 | Gehrie | |

(Continued)

FOREIGN PATENT DOCUMENTS

| | | |
|---|---|---|
| CA | 2154841 | 1/1999 |
| EP | 0020162 | 12/1980 |

(Continued)

*Primary Examiner* — Chi Q Nguyen
(74) *Attorney, Agent, or Firm* — McHale & Slavin, P.A.

(57) ABSTRACT

A lid stay formed from a housing slidably coupled to a base. The housing has a coupler section for securing said housing to a fixed object, and a connector section for securing the housing to the base. The base is formed from a cylindrical shaped tube defining an interior chamber, having an insertion section constructed and arranged to slidably receive said housing, but prevent the connector section of the housing from passing therethrough. An expanded coil spring is positioned within the interior chamber to maintain the housing and base in an expanded position. The lid stay is for use with a storage container base having a lid pivotally attached thereto. The lid stay biases the lid in an open position and provides resistance when closing the lid.

6 Claims, 4 Drawing Sheets

(56) References Cited

U.S. PATENT DOCUMENTS

| | | | | |
|---|---|---|---|---|
| 4,239,093 | A | 12/1980 | Eubanks et al. | |
| 4,522,288 | A | 6/1985 | Wickman et al. | |
| 4,658,473 | A * | 4/1987 | Schema | E05F 1/1261 16/286 |
| 5,401,096 | A * | 3/1995 | Stang | A47B 41/02 16/291 |
| 5,464,115 | A | 11/1995 | Tisbo et al. | |
| 7,845,508 | B2 | 12/2010 | Rothschild et al. | |
| 9,021,743 | B2 * | 5/2015 | Piermee | E02D 29/1418 16/289 |
| 9,121,211 | B1 * | 9/2015 | White | E05F 3/02 |
| 9,638,496 | B2 * | 5/2017 | Peters | F41H 5/013 |
| 2005/0045505 | A1 | 3/2005 | Vandevenne et al. | |
| 2005/0211581 | A1 | 9/2005 | King et al. | |
| 2009/0133219 | A1 * | 5/2009 | Lowry | E05D 11/082 16/304 |
| 2014/0150212 | A1 * | 6/2014 | Collene | E05F 1/1261 16/286 |
| 2019/0257127 | A1 * | 8/2019 | Hogan | E05F 1/105 |

FOREIGN PATENT DOCUMENTS

| | | |
|---|---|---|
| GB | 201781 | 8/1923 |
| GB | 212082 | 3/1924 |
| GB | 217630 | 6/1924 |
| GB | 240093 | 9/1925 |
| GB | 304910 | 1/1929 |
| GB | 317648 | 8/1929 |
| GB | 331753 | 7/1930 |
| GB | 341234 | 1/1931 |
| GB | 353705 | 7/1931 |
| GB | 376927 | 7/1932 |
| WO | WO03064287 | 8/2003 |

* cited by examiner

SPRING SHOCK LID STAY

FIELD OF THE INVENTION

The present invention relates generally to the field of storage containers and, more particularly, to a lid stay device for use with a storage container.

BACKGROUND OF THE INVENTION

Lid stays, both gas and spring based, are known in the industry. Gas shocks are relatively expensive and, in many instances, the capability of a gas shock is not needed. Spring shocks are typically less expensive, but could be improved. Lid stays are particularly beneficial for use with storage containers. A conventional storage container having a lid pivotally attached to a storage base, wherein the lid is opened to provide access to the storage area and closed for concealment of the storage area. A lid stay works well on such storage containers, wherein the lid stay assists the individual in opening of the lid. Essentially, the lid stay provides a counterbalance to the weight of the lid, wherein little or no assistance may be needed to open the lid or keep the lid in an open position. The lid stay provides resistance during the closing of the lid to prevent the lid from slamming shut uncontrollably.

Lid stays come in many configurations, typically with numerous components which can make the device costly to manufacture. Further, multiple components may add to the assembly time, complexity of the device, and number of elements that could possibly fail.

U.S. Pat. No. 5,464,115 discloses a storage container employing a lid stay. The lid stay utilizes a spring positioned within a housing to engage a piston, the piston having a pair of O-rings to provide frictional forces and pneumatic resistance to the piston. The use of the O-rings requires a close tolerance housing, grooves to be fabricated, and O-rings to be installed, all of which add to the manufacturing costs.

What is presented is an improved spring shock lid stay that is inexpensive to manufacture, easy to assembly, and includes provisions that allow for ease of operation.

SUMMARY OF THE INVENTION

The spring shock lid stay device of the present invention includes a plunger body formed from a cylindrical shaped housing defining an interior chamber. A coupler formed on one end of the housing body is used for securing the housing to a fixed object, such as the base of a storage container. A connector is positioned along an opposite end of the housing, preferably formed integral to the housing, providing an opening with an outer surface having a diameter greater than the diameter of the cylindrical shaped housing. A base is also formed from a cylindrical shaped tube defining an interior chamber therein. A first end is constructed and arranged to slidably receive the continuous sidewall of the housing, but prevent the housing connector from passing. An insert end provides access to the interior chamber for receipt of a coil spring. A cap is secured to the insert end, sealing the spring within the interior chamber. The lid stay, being secured between a storage container base and the lid, biases the housing and base in a normally expanded position to allow ease of opening the lid. The spring provides compression resistance when closing the lid, providing a spring shock.

An objective of the invention is to make a low cost lid stay device providing assistance in the opening of storage container lids, and providing a controlled resistance when closing storage container lids.

Yet still another objective of the invention is to provide a lid stay device having a housing that limits movement along a sidewall, allowing ease of coil spring compression into a base, and preventing over extension of the coil spring by preventing a housing connector from passing through an end of the base.

Another objective of the invention is to provide an improve lid stay spring shock that provides smooth operation with minimal components.

Still another objective of the invention is to provide a lid stay device employing an expanded coil spring, wherein compression of the lid stay provides a spring shock.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE PREFERRED EMBODIMENT

A detailed embodiment of the present invention is disclosed herein; however, it is to be understood that the disclosed embodiment is merely exemplary of the invention, which may be embodied in various forms. Therefore, specific structural details and exemplary uses disclosed herein are not to be interpreted as limiting, but merely as a basis for the claims and as a representation basis for teaching one skilled in the art to variously employ the present invention in virtually any appropriately detailed structure or use.

Figure 1:
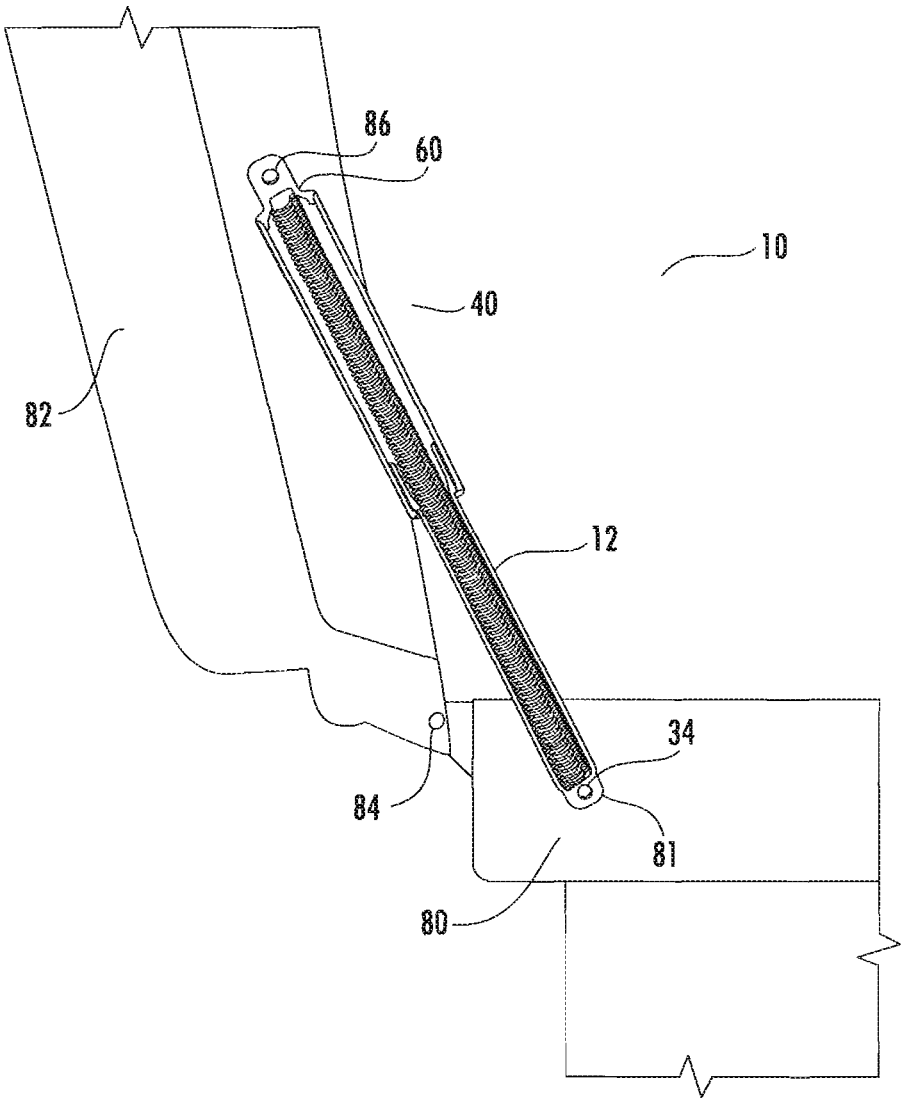
FIG. 1 is a pictorial view of the lid stay positioned on a storage container.
Figure 2:
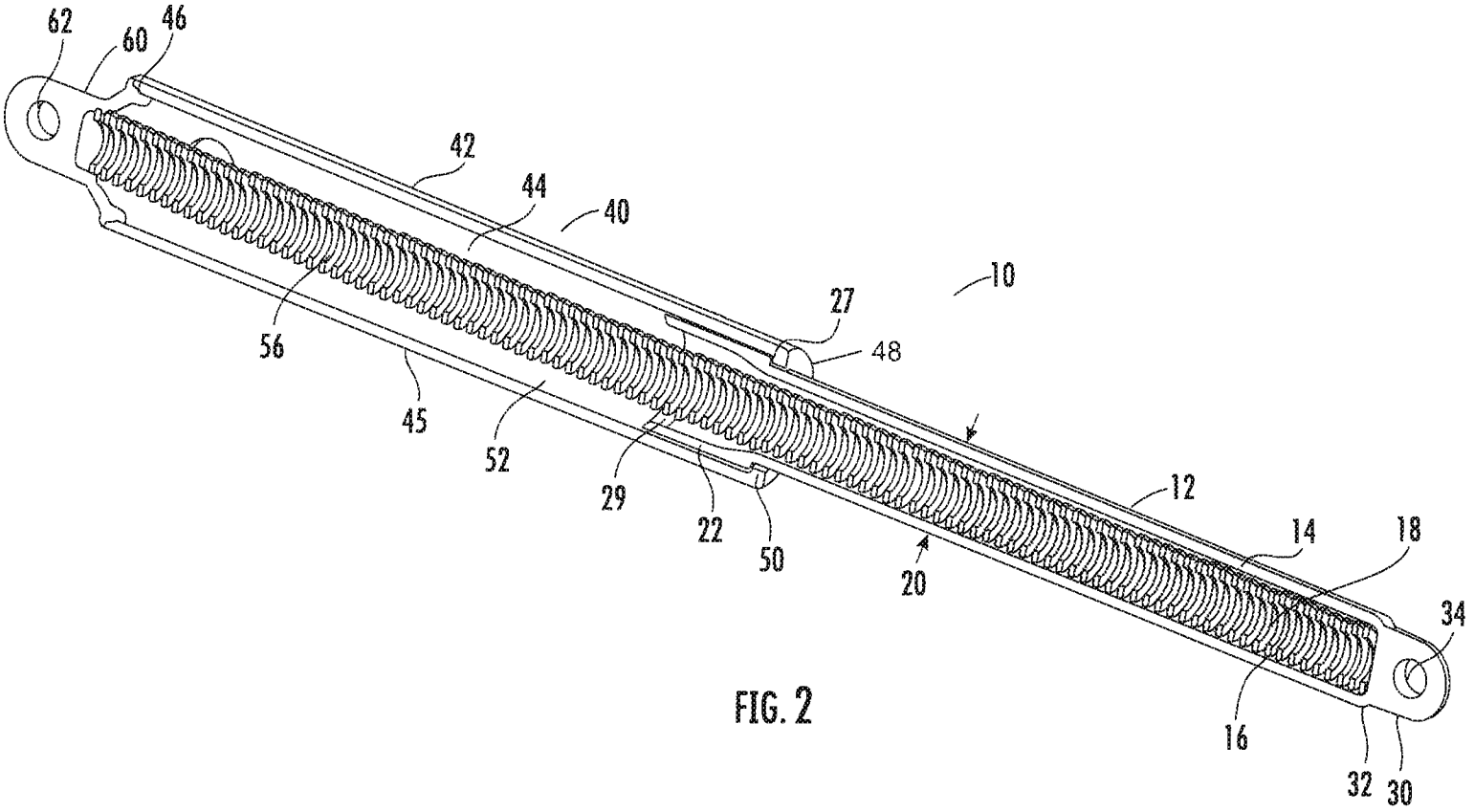
FIG. 2 is a perspective view of the lid stay.
Figure 3:
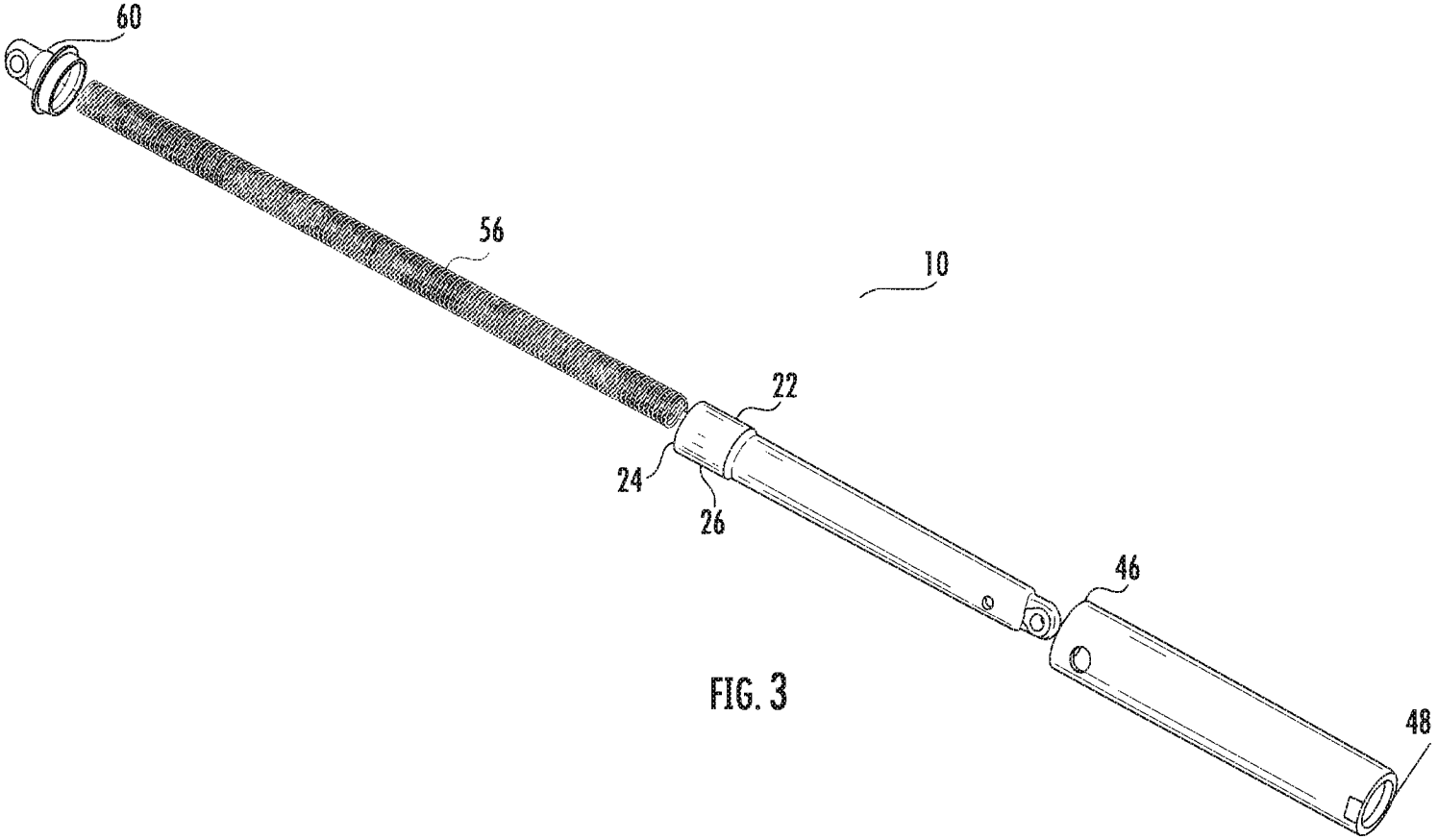
FIG. 3 is an exploded view of the lid stay.

Referring to FIGS. 1-3, set forth is the lid stay of the present invention 10 comprising a cylindrical shaped housing to operate as a plunger. The housing 12 is formed by a continuous sidewall 14 with an inner surface 16 defining an interior chamber 18 and a first outer surface 20 forming an inside diameter. A connector section 22 is located along a proximal end 24 of the housing 12, the connector section 22 having a second outer surface 26 that is greater in diameter than that formed by the first outer surface 20 of the sidewall 14. An inner surface 29 of the connector section 22 has a diameter greater than a diameter formed by inner surface 16 of housing 12. The connector section 22, coupler section 30, and sidewall 14 in this embodiment are preferably made of an injection molded plastic. An outer edge 27 of the connector section 22 provides a buttress positioned perpendicular to an axis of the interior chamber 18 extending along the length of the housing 12.

The coupler section 30 is positioned on the distal end of the housing 12. The coupler section 30 includes an aperture 34 available for securing the housing to a fixed object, such as a storage container base 80.

A base 40 is slidably coupled to the housing 12. The base 40 is formed from a cylindrical shaped tube 42 having a continuous sidewall 45 defining an interior chamber 44 therein. An insert section 46 is constructed and arranged to slidably receive the housing 12 using a capture section 48 sized to prevent the connector section 22 of the housing 12 from passing through. The capture section 48 employs a rib 50 positioned along an inner surface 52 of the interior chamber 44. The rib 50 is constructed and arranged to allow the housing sidewall 14 to pass, but prevent the connector section 22 from passing through the capture section 48.

A coil spring 56 is positioned within the interior chamber 18 of the housing 12 and interior chamber 44 of the base 40. The coil spring 56 is constructed to maintain an expanded position so as to maintain a separation between the housing 12 and base 40 in a normally expanded position.

A cap 60 is securable to the insert section 46. The insert section 46 receives the coil spring 56, and the cap 60 is used to seal the coil spring 56 within the interior chambers 18, 44. In the preferred embodiment, the cap 60 is spin welded to permanently secure the cap 60 to the insert section 46. The cap 60 includes an aperture 62 for ease of connecting the base 40 to an object, such as the lid 82 of the storage container base 80. In operation, the housing coupler section 30 is secured to a storage container base 80 using a fastener 81. Similarly, the cap 60 is attached to the lid 82 of the storage container base 80 by a fastener 86. The spring 56 biases the housing 12 and base 40 in a normally expanded position to allow ease of opening the lid 82. The lid stay 10 maintains the lid 82 in a raised position when the lid 82 is unlatched. The spring 56 of the lid stay 10 provides compression resistance when closing the lid 82 to prevent an uncontrolled closing of the lid. The lid 82 is coupled to the storage container base 80 by at least one hinge 84 to allow pivoting of the lid. In the preferred embodiment, the housing 12, base 40, and cap 60 are formed from plastic; the coil spring 56 is constructed from steel.

Figure 4:
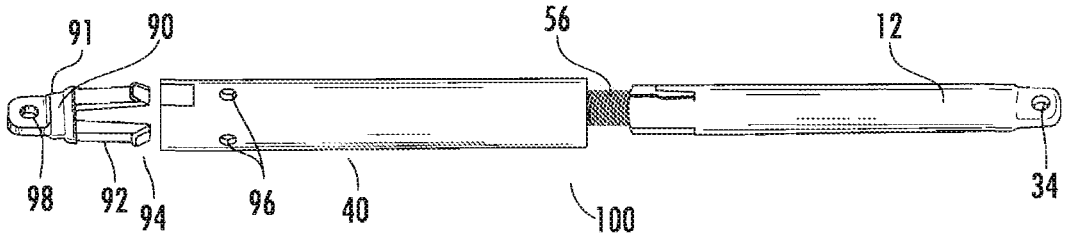
FIG. 4 is an exploded view of an alternative embodiment of the lid stay cap.
Figure 5:
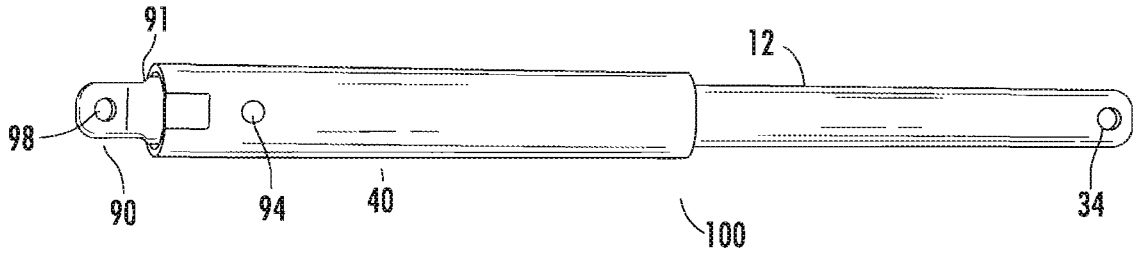
FIG. 5 is the embodiment of FIG. 4 assembled.

Referring to FIGS. 4 and 5, illustrated is an alternative embodiment. The lid stay 200 illustrated maintains the housing 12, base 40, and spring 56 in the same configuration as previously mentioned. In this embodiment, cap 90 includes fingers 92 which are biased outwardly from a base 91 with end tabs 94 operatively associated with receptacles 96 formed along the end of the base 40. The end tabs 94 snap into the receptacles 96 during installation, wherein the outwardly biasing fingers maintain the end tabs in the receptacles to prevent removal of the cap 90 from the base 40. An aperture 98 formed in the cap allows for ease of securing the base 40 to an object.

The use of the word "a" or "an" when used in conjunction with the term "comprising" in the claims and/or the specification may mean "one," but it is also consistent with the meaning of "one or more" or "at least one." The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more elements, is not limited to possessing only those one or more elements. Furthermore, a device or structure that is configured in a certain way is configured in at least that way, but may also be configured in ways that are not listed.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims. The term "coupled" is defined as connected, although not necessarily directly, and not necessarily mechanically.

What is claimed is:

1. A lid stay comprising:

a cylindrical shaped housing formed from a continuous sidewall defined by a first outer surface having a diameter and an inner surface defining a first interior chamber, a connector section positioned along one end of said housing and a coupler section positioned on an opposite end of said housing, said connector section having a second outer surface that is greater in diameter than said first outer surface of said housing sidewall;

a base formed from a cylindrical shaped tube having a continuous sidewall defining a second interior chamber therein with an insert section constructed and arranged to slidably receive said continuous sidewall of said housing and a capture section preventing said connector section from passing therethrough;

a cap securable to said insert section of said base; and a spring positioned within said first and second interior chambers, said spring biased in an expanded position;

wherein said housing coupler section is secured to a storage container base having a lid to provide ease of lid opening, whereby said spring biases said housing and said base in a normally extended position to stay the lid in an open position and provide spring compression resistance when closing the lid.

2. The lid stay according to claim 1 wherein said cap includes an aperture available for securing said housing to a fixed object with a fastener.

3. The lid stay according to claim 1 wherein said cap is secured to said base with a spin weld.

4. The lid stay according to claim 1 wherein said cap includes a plurality of fingers with end tabs available to engage apertures formed in said base, wherein said end tabs are insertable into said apertures for securing said cap to said base.

5. The lid stay according to claim 1 wherein said coupler section includes an aperture available for securing said housing to a fixed object with a fastener.

6. The lid stay according to claim 1 wherein said capture section is further defined as a rib positioned along an inner surface of the interior chamber of said base, said rib sized to allow said housing sidewall to pass, but prevent said connector section from passing therethrough.

* * * * *